US010456319B2

(12) United States Patent
Ennis

(10) Patent No.: US 10,456,319 B2
(45) Date of Patent: Oct. 29, 2019

(54) FASCIA THERAPY TOOL

(71) Applicant: Kristie Orecchio Ennis, Canterbury, NH (US)

(72) Inventor: Kristie Orecchio Ennis, Canterbury, NH (US)

( * ) Notice: Subject to any disclaimer, the term of this patent is extended or adjusted under 35 U.S.C. 154(b) by 65 days.

(21) Appl. No.: 15/956,782

(22) Filed: Apr. 19, 2018

(65) Prior Publication Data

US 2019/0029916 A1 Jan. 31, 2019

Related U.S. Application Data

(60) Provisional application No. 62/539,468, filed on Jul. 31, 2017.

(51) Int. Cl.
*A61H 7/00* (2006.01)

(52) U.S. Cl.
CPC ..... *A61H 7/003* (2013.01); *A61H 7/001* (2013.01); *A61H 7/007* (2013.01); *A61H 2201/1692* (2013.01); *A61H 2201/1695* (2013.01)

(58) Field of Classification Search
CPC ..... A61H 7/003; A61H 7/007; A61H 7/00; A61H 7/001; A61H 7/002; A61H 2201/1695
USPC ..... D24/200, 211–215
See application file for complete search history.

(56) References Cited

U.S. PATENT DOCUMENTS

| | | | | | |
|---|---|---|---|---|---|
| D180,888 | S | * | 9/1957 | Bartell et al. | D24/215 |
| D223,418 | S | * | 4/1972 | Hess | D24/214 |
| D246,345 | S | * | 11/1977 | Poncia | D8/14 |
| 4,097,951 | A | * | 7/1978 | Hurtt | B05C 17/10 15/144.1 |
| 4,590,926 | A | * | 5/1986 | Courtin | A61H 7/003 601/134 |
| 5,626,683 | A | * | 5/1997 | Blouin | A47L 17/06 134/7 |
| D530,429 | S | * | 10/2006 | Sevier | D24/214 |
| D544,608 | S | * | 6/2007 | Hsu | D24/214 |
| D677,394 | S | * | 3/2013 | Grust | D24/215 |
| D683,862 | S | * | 6/2013 | Hartman | D24/214 |
| D715,452 | S | * | 10/2014 | Schiavon | D24/200 |
| D792,600 | S | * | 7/2017 | van den Dries | D24/215 |
| 2007/0191745 | A1 | * | 8/2007 | Tucker | A61H 7/00 601/135 |
| 2008/0177207 | A1 | * | 7/2008 | Liao | A61H 7/003 601/137 |
| 2015/0231014 | A1 | * | 8/2015 | Capobianco | B25F 1/00 601/135 |

* cited by examiner

*Primary Examiner* — Kristen Matter
(74) *Attorney, Agent, or Firm* — Frank Marino

(57) ABSTRACT

A rigid tool is used in fascia therapy and includes a handle and a blade. The handle is an elongate cylinder having a length of 4.5 inches and a diameter of 1 inch. The blade is a flat plate having a thickness ¼ inch and a width of 4.5 inches. The blade is rigidly affixed at a proximal end to and extends outwardly from the handle. The blade has a distal edge with a curved contour devoid of sharp corners across its width.

17 Claims, 2 Drawing Sheets

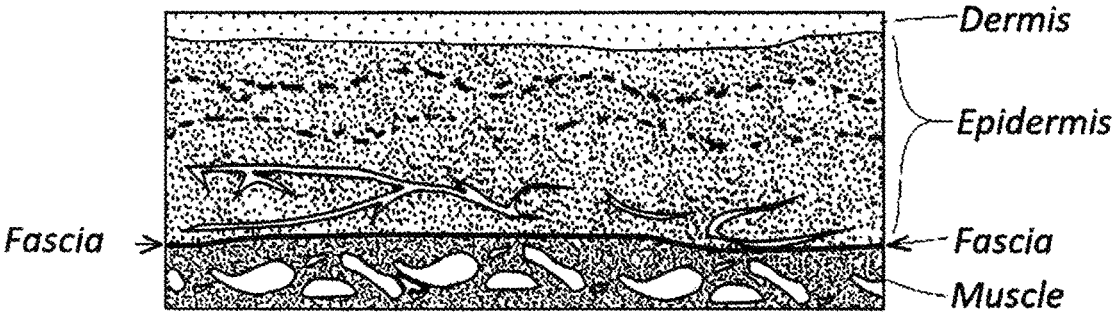
*Fig.1*
(PRIOR ART)
*Fig.6*
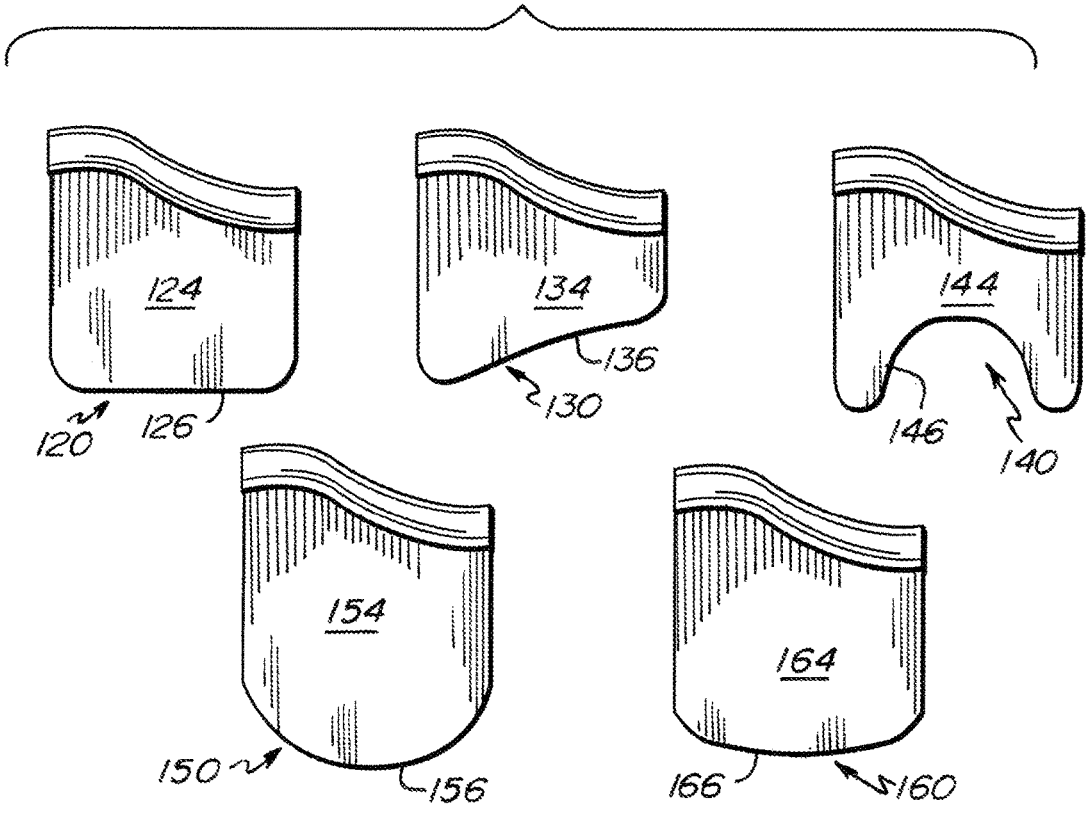

FASCIA THERAPY TOOL

RELATED APPLICATION

This application claims the benefit of U.S. Provisional Application No. 62/539,468 filed on 31 Jul. 2017, the teachings of which are claimed herein by reference in their entirety.

FIELD OF THE INVENTION

The invention relates to a tool for, and the performance of, physical therapy on fascia tissue, to treat musculoskeletal ailments. The device is particularly well suited for self-applied therapy.

BACKGROUND

Fascia is a thin layer of tissue that covers most muscles, tendons and organs in the body. FIG. 1 shows a partial area of the skin to depict the fascia therein. From www.drnorthrup.com/muscle-facia/;

> " . . . every inch of your body is encased in fascia . . . . Fascia is made up of densely packed collagen fibers that wrap around each of your internal organs and connect them to your muscles and bones . . . . Your fascia has the ability to contract and relax independently of the muscles it surrounds . . . when your fascia is tight or inflamed it can cause a great deal of pain. In fact, it can be a primary source of chronic or referral pain for many people . . . . Connective tissue, including fascia, is loaded with receptor membranes that communicate with all of the other receptor membranes in your body . . . . This is why when your feet hurt, your whole body hurts . . . . Your fascia stretches and moves to support your body, and actually protects you from overstretching . . . if you hurt yourself, your fascia adapts to protect your body from further injury . . . if you sit all day slumped over a computer, you put abnormal stress on your fascia. And, it molds itself along the lines of your posture . . . . Over time, this can lead to impairment throughout your entire body. On the other hand, when you change your alignment, get regular massage, . . . , you can create health throughout your entire body . . . When fascia is healthy, it's flexible and returns to its original shape after being twisted and squeezed."

Cellulite is a fatty deposit that collects between the fascia and its underlying muscle. It often takes on an uneven configuration that causes the overlying skin to appear bumpy and unattractive. From skinagain.com/secret-solution-reduce-cellulite-good;

> "If you have cellulite, commonly disguised as fluffy, rippled, dimply areas that often resemble cottage cheese, you're not alone. Nearly 9 out of 10 women have some degree of cellulite on their thighs, tush, bellies and arms. Today, women spend over $12 million a year to reduce cellulite using treatments ranging from non-invasive creams to risky surgeries to remove this unwanted fat.
>
> What exactly is cellulite? Cellulite occurs when pockets of fat push up against your fascia or connective tissue underneath the skin where toxins get trapped. Hormones, lack of exercise, poor circulation, scar tissue, dehydration of the tissue and diet all contribute to the formation of cellulite. Cellulite is also due to congestion in the body's lymphatic system. The lymph system acts as your bodies' filtration system targeting toxins and germs and removing what it can to protect you. When the lymphatic system is operating efficiently, it filters out the toxins and germs through normal body functions. But when the lymphatic system becomes congested, this process becomes sluggish, making it difficult for your body to effectively deal with them and they get stuck and place an increasing strain on the immune system and can also lead to unsightly cellulite! . . . . New scientific research is now describing fascia as an organ of highly variable connective tissue that influences the shape, tone and fluidity of the human body. Addressing the fascial system can help reduce cellulite and change the shape of your body by smoothing out and hydrating your connective tissue, which lays just below the skin, while also stimulating your lymphatic system to flush out stuck toxins. Cellulite forms in the superficial fascia, the layer of connective tissue below the skin that contains fat cells. Superficial fascia can be thick and fibrous due to inactivity, injuries, incorrect posture or alignment and improper exercise or movement patterns. When this happens adhesions, otherwise known as "scar tissue" or "knots" in the fascia can form and build up, contributing to the bunched-up, dense or rippled look of the skin."

There exists a need, and it is an objective of the invention, to provide an effective means for treating facia to remove the lumpiness of cellulite.

Additional needs and objectives will become apparent by a review of the following disclosure.

SUMMARY OF THE INVENTION

The invention may be embodied in, or practiced using, a tool for treating the fascia to reduce the appearance of cellulite and to treat other musculoskeletal ailments, including plantar fasciitis, tennis and golfers elbow, IT band syndrome, piriformis syndrome, shin splints, rotator cuff tendinitis and tears, and muscle strains. The device is particularly well suited for self-applied therapy. The tool may be used on a patient by a professional or may be used by the patient on his or herself.

The present invention provides a low cost non-complicated apparatus which is simple to use so that it is practical for self-therapy, and so that the self-therapy will be easy enough to promote regular, even daily, use.

The invention may be embodied in or practiced using a rigid tool for use in fascia therapy having a handle portion and a blade portion. The handle portion may be an elongate cylinder having a length from three to five inches and a diameter from three-quarters of an inch to two inches defining a central longitudinal axis. The blade portion may be a flat plate having a thickness from one-eighth to three-eighths of an inch and a width from three to six inches, the width being measured from a first transverse side edge to a second transverse side edge and approximately equal to and aligned with the length of the handle portion, and the blade portion may be rigidly affixed at a proximal end thereof to and extending out from the handle portion co-planarly with the longitudinal axis.

The blade portion may have a distal edge having a curved contour devoid of sharp corners across the width, rounded corners at the intersections of the distal edge and the side edges, and a rounded shape across the thickness. The blade portion may extend out from the handle portion three to five inches. The curved contour may include a concave radius of four to eight inches. The rounded corners at the intersections of the distal edge and the side edges may have a radius of one-quarter of an inch to one inch.

The tool may be made of one or more of metal, plastic, and wood. The tool may be made of aluminum. The tool may be fabricated by one or both of welding and casting. The tool of claim 16 made by molding.

The tool may be right-handed, left-handed, or useable by either hand.

The tool may be made available in a variety of different sizes to serve differently-sized patients or different areas of the body, and its interfacing distal end may be available in a variety of contours to interact most effectively with various parts of the body.

The foregoing summary, as well as the following detailed description will be better understood when read in conjunction with the appended drawings. There are shown in the drawings an embodiment which is presently preferred. It should be understood, however, that the disclosure is not limited to the precise arrangements and instrumentalities shown.

BRIEF DESCRIPTION OF THE DRAWINGS

The various objects, advantages and novel features of this invention will be more fully apparent from a reading of the following detailed description of an exemplary embodiment thereof, in conjunction with the accompanying drawings in which like reference numerals refer to like parts, and in which:

FIG. 1 is a partial cross-section through typical human skin to depict the fascia therein;

FIG. 6 is a series of views of alternate distal end shapes for additional fascia therapy tool embodiments.

DESCRIPTION OF AN EXEMPLARY EMBODIMENT

Figure 3:
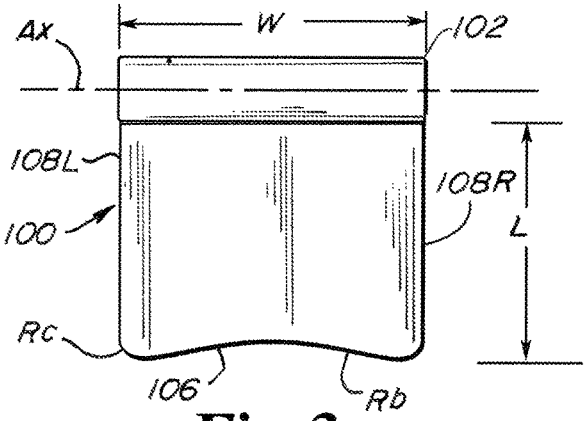
FIG. 3 is a front view of the tool of FIG. 2.
Figure 2:
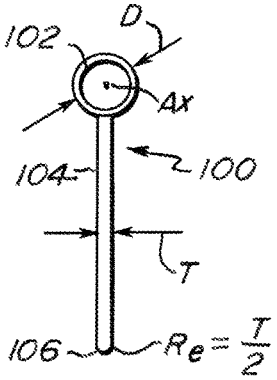
FIG. 2 is side view of a fascia therapy tool in accordance with a first exemplary embodiment.

Referring to FIGS. 2 and 3, an exemplary tool 100 is shown which has a blade portion 104 with an interfacing edge 106 at its distal end and a handle portion 102 affixed to its proximal end. The device is preferably fabricated of aluminum or plastic. When of aluminum, the handle portion and blade portion may be welded together (as shown), of both may be integrally formed by die-casting or extruding (with post-machining).

The handle portion as shown is made of hollow tubing having a diameter D of one inch and a width W of four and one-half inches. The diameter defines a central longitudinal axis A.

The blade is made of aluminum plate having a thickness T of one-quarter of an inch and the same width W of four and one-half inches.

Measured from the outside of the handle portion to the rounded corners $R_c$ of the blade portion, the blade portion's length L is three and one-half inches.

As seen in FIG. 3, the distal edge 106 has a contour including a sweeping concave radius $R_b$ of five inches, and the afore-stated rounded corners both have a radius $R_c$ of three-eighths of an inch.

As seen in FIG. 2, the distal edge is rounded across thickness T with a radius $R_c$ of one-eighth of an inch (T/2). All remaining external edges of the blade portion and handle portion are slightly rounded to remove sharp edges Of course, the device could be made of any material which provides satisfactory performance, such as plastic, wood, or some other metal. And the device could be manufactured by some other process. For instance, if made of plastic it could be injection molded. Or if made of wood, the handle could be glued to the blade. The particular material and fabrication method used for the exemplary embodiment shown are not critical to the invention so long as the discovered functional benefits are achieved.

Figure 4:
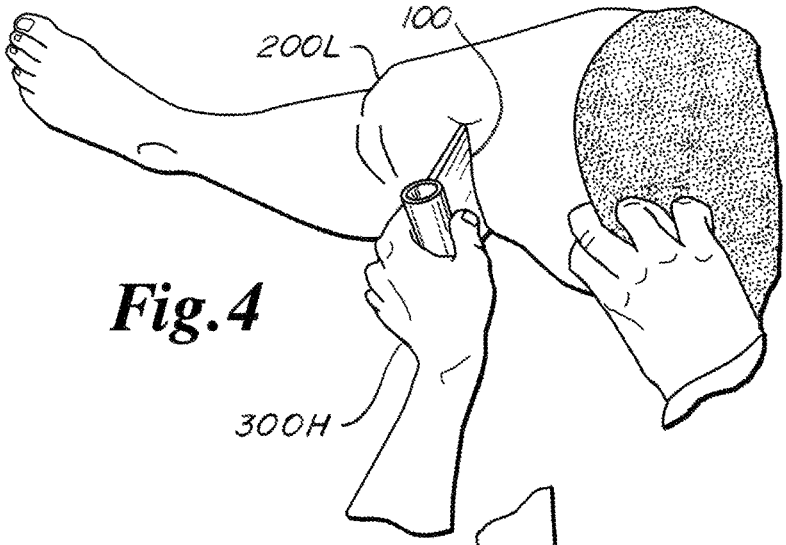
FIG. 4 is a view the tool of FIG. 2 treating leg fascia.
Figure 5:
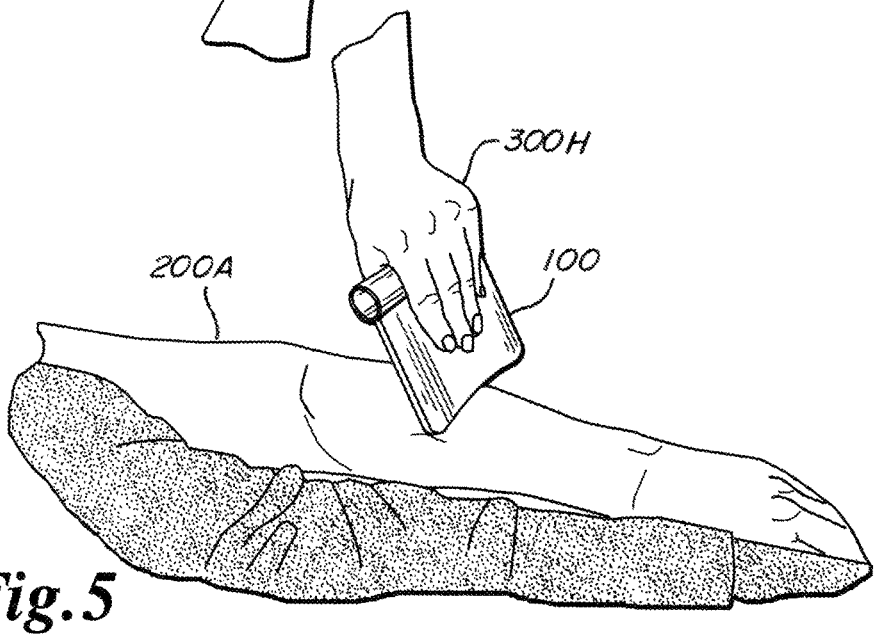
FIG. 5 is a view the tool of FIG. 2 treating arm fascia.

Referring to FIGS. 4 and 5, the exemplary tool 100 is shown being used on a patient's leg 200L and arm 200A, respectively. The therapist (or patient herself if self-treating) first recognizes areas of the skin that feel or appear bumpy, indicating the presence of cellulite. A lotion may be applied to the skin over that area to provide lubrication. The therapist grasps the tool by the handle and places the distal edge against the skin in that area. Cellulite tends to form with a "direction" or "grain", and the therapist next wipes the interfacing edge gently over the skin to recognize the grain of the underlying cellulite. In one direction the cellulite will generally feel smoother, while in the opposite direction it will feel bumpier. The therapist leans the blade at a 30-60 degree angle relative to the surface of the skin and applies firm but gently pressure while pushing the distal edge as shown more firmly against the skin in the direction that the bumpiness was most prominent. The therapist may alternatively stand in a pulling position and pull the tool against the skin in the same disposition and direction.

In the case of FIGS. 4 and 5, the bumpiness was most prominent towards to foot and hand, respectively, so the therapist leans the tool back 45 degrees towards the patient's head and, starting towards the hip and elbow, respectively, pushes the interfacing edge towards the knee and wrist, respectively.

After only a few such treatments, repeated every few seconds and lasting between two and three seconds per pass, the bumpiness in the underlying cellulite is smoothed and the grain is removed such that the cellulite feels virtually equally smooth in either direction.

While the photos demonstrate treatment for cellulite appearance reduction in the leg and arm, it should be recognized that any stretching, massaging, or "working" of the fascia anywhere around the body is beneficial and therapeutic. The underside of the foot is particularly susceptible to plantar fasciitis, which can be removed or at least reduced with similar treatment.

Reference is next made to FIG. 6. While the sweeping concave radius of the distal edge of tool 100 is found to be most universal in its ability to treat the widest variety of patients in the widest variety of body areas, certain areas and patients could benefit from a shape that is more specific to the area they wish to treat. For instance, the flat distal edge 126 of tool 120 may be more effective on certain parts of the body, or a more sharply curved concave radius of distal edge 146 of tool 140 edge may be more effective on other parts. The biased distal edge 136 of tool 130, which may be used as shown or flipped to a mirror-image disposition, allows access to smaller treatment areas, and the convexly radiused distal edges 156 and 166 of tools 150 and 160 are useful in reaching into depressions such as along the spine.

It is therefore anticipated that, while the above-described device may be made available for universal use, numerous other such devices may be made and sold having different curvatures according to the patient's particular need. This range of devices might even be packaged as sets.

FIG. 8 shows several of the infinite number of edge contours which may be most functional for servicing various patients and various body areas.

Additionally, the handle of the disclosed embodiment is symmetrical so that it may be used by either left-handed or right-handed persons, but when sold commercially, it may be advantageous to provide right-handed and left-handed versions, which are intended to be within the invention.

I claim:

1. A rigid tool for use in fascia therapy comprising a handle portion and a blade portion;

the handle portion comprising an elongate cylinder having a length from three to five inches and a diameter from three-quarters of an inch to two inches defining a central longitudinal axis;

the blade portion comprising a flat plate having a thickness from one-eighth to three-eighths of an inch and a width from three to five inches, the width being measured from a first transverse side edge to a second transverse side edge and approximately equal to and aligned with the length of the handle portion, and the blade portion being rigidly affixed at a proximal end thereof to and extending out from the handle portion co-planarly with the longitudinal axis; wherein the blade portion further comprises a distal edge having a curved contour devoid of sharp corners across the width, rounded corners at the intersections of the distal edge and the side edges, and a rounded shape across the thickness.

2. The tool of claim 1 wherein the width is four and one-half inches.

3. The tool of claim 2 wherein the thickness is one-quarter of an inch.

4. The tool of claim 3 wherein the diameter is one inch.

5. The tool of claim 4 wherein the blade portion extends out from the handle portion three to five inches.

6. The tool of claim 5 wherein the blade portion extends out from the handle portion three and one-half inches.

7. The tool of claim 6 wherein the curved contour comprises a concave radius of four to eight inches.

8. The tool of claim 7 wherein the curved contour comprises a concave radius of five inches.

9. The tool of claim 8 wherein the rounded corners at the intersections of the distal edge and the side edges comprise a radius of one-quarter of an inch to one inch.

10. The tool of claim 9 wherein the rounded corners at the intersections of the distal edge and the side edges comprise a radius of three-eighths of an inch.

11. The tool of claim 10 comprised of one or more of metal, plastic, and wood.

12. The tool of claim 11 comprised of metal.

13. The tool of claim 12 comprised of aluminum.

14. The tool of claim 13 fabricated by one or both of welding and casting.

15. The tool of claim 14 fabricated by casting.

16. The tool of claim 11 comprised of plastic.

17. The tool of claim 16 fabricated by molding.

* * * * *